US012559217B1

(12) United States Patent
Arbuckle et al.

(10) Patent No.: US 12,559,217 B1
(45) Date of Patent: Feb. 24, 2026

(54) MARINE PROPULSION CONTROL SYSTEMS AND METHODS WITH BUFFER ZONE ADAPTATION

(71) Applicant: Brunswick Corporation, Mettawa, IL (US)

(72) Inventors: Jason S. Arbuckle, Horicon, WI (US); Brandon L. Tate, Walnut Hill, IL (US)

(73) Assignee: Brunswick Corporation, Mettawa, IL (US)

( * ) Notice: Subject to any disclaimer, the term of this patent is extended or adjusted under 35 U.S.C. 154(b) by 116 days.

(21) Appl. No.: 18/403,133

(22) Filed: Jan. 3, 2024

(51) Int. Cl.
*B63H 21/21* (2006.01)
*B63B 7/02* (2020.01)
*B63B 79/15* (2020.01)

(52) U.S. Cl.
CPC ..... *B63H 21/21* (2013.01); *B63B 7/02* (2013.01); *B63B 79/15* (2020.01)

(58) Field of Classification Search
CPC ..... B63H 21/21; B63B 79/15; B63B 7/02
USPC ..... 701/21
See application file for complete search history.

(56) References Cited

U.S. PATENT DOCUMENTS

| | | | |
|---|---|---|---|
| 1,027,977 | A | 5/1912 | Beck |
| 6,234,100 | B1 | 5/2001 | Fadeley et al. |
| 6,273,771 | B1 | 8/2001 | Buckley et al. |
| 7,267,068 | B2 | 9/2007 | Bradley et al. |
| 7,725,253 | B2 | 5/2010 | Foxlin |
| 8,195,381 | B2 | 6/2012 | Arvidsson |
| 8,622,778 | B2 | 1/2014 | Tyers et al. |
| 9,039,469 | B1 | 5/2015 | Calamia et al. |
| 9,120,540 | B1 | 9/2015 | Foss et al. |
| 9,183,711 | B2 | 11/2015 | Fiorini et al. |
| 9,355,463 | B1 | 5/2016 | Arambel et al. |
| 9,615,006 | B2 | 4/2017 | Terre et al. |
| 9,650,119 | B2 | 5/2017 | Morikami et al. |
| 9,729,802 | B2 | 8/2017 | Frank et al. |
| 9,734,583 | B2 | 8/2017 | Walker et al. |

(Continued)

FOREIGN PATENT DOCUMENTS

| | | |
|---|---|---|
| CA | 2279165 | 1/2001 |
| CA | 2282064 | 1/2001 |

(Continued)

OTHER PUBLICATIONS

European Search Report dated Apr. 29, 2020 in counterpart European Patent Application 19216250.1.

(Continued)

*Primary Examiner* — Yazan A Soofi
(74) *Attorney, Agent, or Firm* — Andrus Intellectual Property Law, LLP

(57) ABSTRACT

A propulsion control system includes at least one marine drive configured to propel the marine vessel, a proximity sensor system configured to measure proximity of objects in a marine navigation area around the marine vessel to generate proximity measurements, and a control system. The control system is configured detect that an extendable element on the marine vessel is in an extended position, define an extended buffer zone around the marine vessel based on the extended position of the extendable element, and control the at least one marine drive based on the proximity measurements and the buffer zone so as to avoid the objects in the marine navigation area entering the extended buffer zone.

20 Claims, 8 Drawing Sheets

(56) References Cited

U.S. PATENT DOCUMENTS

| | | | | |
|---|---|---|---|---|
| 9,778,657 | B2 | 10/2017 | Tyers | |
| 9,878,769 | B2 | 1/2018 | Kinoshita et al. | |
| 9,908,605 | B2 | 3/2018 | Hayashi et al. | |
| 9,927,520 | B1 | 3/2018 | Ward et al. | |
| 9,988,134 | B1 | 6/2018 | Gable et al. | |
| 9,996,083 | B2 | 6/2018 | Vojak | |
| 10,037,701 | B2 | 7/2018 | Harnett | |
| 10,048,690 | B1 | 8/2018 | Hilbert et al. | |
| 10,055,648 | B1 | 8/2018 | Grigsby et al. | |
| 10,106,227 | B2 | 10/2018 | Allender | |
| 10,106,238 | B2 | 10/2018 | Sidki et al. | |
| 10,126,748 | B2 | 11/2018 | Akuzawa et al. | |
| 10,191,153 | B2 | 1/2019 | Gatland | |
| 10,191,490 | B2 | 1/2019 | Akuzawa et al. | |
| 10,259,555 | B2 | 4/2019 | Ward et al. | |
| 10,281,917 | B2 | 5/2019 | Tyers | |
| 10,338,800 | B2 | 7/2019 | Rivers et al. | |
| 10,429,845 | B2 | 10/2019 | Arbuckle et al. | |
| 10,431,099 | B2 | 10/2019 | Stewart et al. | |
| 10,444,349 | B2 | 10/2019 | Gatland | |
| 10,507,899 | B2 | 12/2019 | Imamura et al. | |
| 10,746,552 | B2 | 8/2020 | Hashizume et al. | |
| 11,403,955 | B2 | 8/2022 | Derginer et al. | |
| 11,505,292 | B2 * | 11/2022 | Johnson | G01S 13/862 |
| 11,600,184 | B2 | 3/2023 | Derginer et al. | |
| 2003/0137445 | A1 | 7/2003 | Van Rees et al. | |
| 2005/0075016 | A1 | 4/2005 | Bertetti et al. | |
| 2006/0058929 | A1 | 3/2006 | Fossen et al. | |
| 2007/0089660 | A1 | 4/2007 | Bradley et al. | |
| 2011/0153125 | A1 | 6/2011 | Arbuckle et al. | |
| 2011/0172858 | A1 | 7/2011 | Gustin et al. | |
| 2014/0316657 | A1 | 10/2014 | Johnson et al. | |
| 2015/0009325 | A1 | 1/2015 | Kardashov | |
| 2015/0032305 | A1 | 1/2015 | Lindeborg | |
| 2015/0089427 | A1 | 3/2015 | Akuzawa | |
| 2015/0134146 | A1 | 5/2015 | Pack et al. | |
| 2015/0172545 | A1 | 6/2015 | Szabo et al. | |
| 2015/0276923 | A1 | 10/2015 | Song et al. | |
| 2015/0288891 | A1 | 10/2015 | Johansson et al. | |
| 2015/0294660 | A1 | 10/2015 | Stokes et al. | |
| 2015/0375837 | A1 | 12/2015 | Johnson et al. | |
| 2015/0378361 | A1 | 12/2015 | Walker et al. | |
| 2016/0041039 | A1 | 2/2016 | Olsson | |
| 2016/0069681 | A1 | 3/2016 | Johnson et al. | |
| 2016/0070265 | A1 | 3/2016 | Liu et al. | |
| 2016/0125739 | A1 | 5/2016 | Stewart et al. | |
| 2016/0162145 | A1 | 6/2016 | Rivers et al. | |
| 2016/0187140 | A1 | 6/2016 | Clarke et al. | |
| 2016/0196653 | A1 | 7/2016 | Grant et al. | |
| 2016/0214534 | A1 | 7/2016 | Richards et al. | |
| 2016/0334794 | A1 | 11/2016 | Johnson et al. | |
| 2016/0370187 | A1 | 12/2016 | Gatland et al. | |
| 2017/0052029 | A1 | 2/2017 | Ninomiya et al. | |
| 2017/0059705 | A1 | 3/2017 | Stokes et al. | |
| 2017/0064238 | A1 | 3/2017 | Kardashov | |
| 2017/0090021 | A1 | 3/2017 | Sayer et al. | |
| 2017/0146642 | A1 | 5/2017 | Stokes et al. | |
| 2017/0167871 | A1 | 6/2017 | Johnson et al. | |
| 2017/0168159 | A1 | 6/2017 | Gatland | |
| 2017/0176586 | A1 | 6/2017 | Johnson et al. | |
| 2017/0184414 | A1 | 6/2017 | Johnson et al. | |
| 2017/0205829 | A1 * | 7/2017 | Tyers | B63H 25/04 |
| 2017/0227639 | A1 | 8/2017 | Stokes et al. | |
| 2017/0243360 | A1 | 8/2017 | Schulte | |
| 2017/0253314 | A1 | 9/2017 | Ward | |
| 2017/0277189 | A1 | 9/2017 | Johnson et al. | |
| 2017/0285134 | A1 | 10/2017 | Stokes et al. | |
| 2017/0300056 | A1 | 10/2017 | Johnson et al. | |
| 2017/0365175 | A1 * | 12/2017 | Harnett | B63H 20/14 |
| 2017/0371348 | A1 | 12/2017 | Mou | |
| 2018/0023954 | A1 | 1/2018 | Rivers | |
| 2018/0050772 | A1 | 2/2018 | Koyano et al. | |
| 2018/0057132 | A1 | 3/2018 | Ward et al. | |
| 2018/0081054 | A1 | 3/2018 | Rudzinsky et al. | |
| 2018/0259338 | A1 | 9/2018 | Stokes et al. | |
| 2018/0259339 | A1 | 9/2018 | Johnson et al. | |
| 2018/0292529 | A1 | 10/2018 | Hogasten | |
| 2019/0098212 | A1 | 3/2019 | Shain et al. | |
| 2019/0137618 | A1 | 5/2019 | Hawker | |
| 2019/0251356 | A1 | 8/2019 | Rivers | |
| 2019/0258258 | A1 | 8/2019 | Tyers | |
| 2019/0283855 | A1 | 9/2019 | Nilsson | |
| 2019/0299983 | A1 | 10/2019 | Shalev-Shwartz et al. | |
| 2020/0193840 | A1 * | 6/2020 | Derginer | B63B 43/18 |
| 2020/0202719 | A1 * | 6/2020 | Derginer | B63B 79/40 |
| 2020/0247518 | A1 * | 8/2020 | Dannenberg | B63H 25/42 |
| 2020/0250992 | A1 * | 8/2020 | Derginer | B63H 25/04 |
| 2022/0268585 | A1 * | 8/2022 | Tulgara | G01C 21/203 |

FOREIGN PATENT DOCUMENTS

| | | |
|---|---|---|
| CN | 110325823 | 10/2019 |
| DE | 11 2013 004908 | 6/2015 |
| EP | 1 775 212 | 4/2007 |
| EP | 1873052 | 1/2008 |
| EP | 3 182 155 | 6/2017 |
| EP | 2824528 | 3/2019 |
| JP | 7-246998 | 10/1999 |
| JP | 2016049903 | 4/2016 |
| JP | 2017178242 | 10/2017 |
| KR | 20140011245 | 1/2014 |
| WO | 9305406 | 3/1993 |
| WO | 2006040785 | 4/2006 |
| WO | 2006 062416 | 6/2006 |
| WO | 2008 066422 | 6/2008 |
| WO | 2012010818 | 1/2012 |
| WO | 2017 095235 | 6/2017 |
| WO | 2017167905 | 10/2017 |
| WO | 2017168234 | 10/2017 |
| WO | 2017205829 | 11/2017 |
| WO | 2018162933 | 9/2018 |
| WO | 2018172849 | 9/2018 |
| WO | 2018183777 | 10/2018 |
| WO | 2018201097 | 11/2018 |
| WO | 2018232376 | 12/2018 |
| WO | 2018232377 | 12/2018 |
| WO | 2019011451 | 1/2019 |
| WO | 2019096401 | 5/2019 |
| WO | 2019126755 | 6/2019 |
| WO | 2019157400 | 8/2019 |
| WO | 2019180506 | 9/2019 |
| WO | 2019201945 | 10/2019 |

OTHER PUBLICATIONS

John Bayless, Adaptive Control of Joystick Steering in Recreational Boats, Marquette University, Aug. 2017, https://epublications.marquette.edu/cgi/viewcontent.cgi?article=1439&context=theses_open.

W. Xu et al., "Internet of Vehicles in Big Data Era." in IEEE/CAA Journal of Automatica Sinica, vol. 5, No. 1, pp. 19-35, Jan. 2018, doi: 10.1109/JAS.2017.7510736. (Year 2018).

An Autonomous Solar-Powered Marine Robitic Ibservatory for Permanent Monitoring of Large Areas of Shallow Water by I. Gonzalez-Reolid et al.; Sensors 2018, 18(10), 3497; https://doi.org/10.3390/s18103497 (Year 2018).

S. Reed and V.E. Schmidt, "Providing Nautical Chart Awareness to Autonomous Surface Vessel operations," Oceans 2016 MTS/IEEE Monterery, 2016, pp. 1-8, doi: 10.1109/OCEANS.2016.7761472 (Year 2016).

* cited by examiner

MARINE PROPULSION CONTROL SYSTEMS AND METHODS WITH BUFFER ZONE ADAPTATION

FIELD

The present disclosure generally relates to propulsion control systems and methods for controlling propulsion of a marine vessel, and more specifically to propulsion control systems and methods that adapt a buffer zone around a marine vessel to accommodate an extended element.

BACKGROUND

The following U.S. Patents are incorporated herein by reference, in entirety:

U.S. Pat. No. 9,120,540 discloses a dive door for a marine vessel, the dive door having a planar body having an interior surface and an exterior surface. The door is disposed between the gunwale of the boat and is hingeably attached to the deck of the boat. The door is releasably retained to the gunwale by one or more latches disposed at a top edge of the dive door. One or more gas shocks are attached to the door and the boat so that the dive door is selectively operable between a deployed position and a closed position. When deployed, the interior surface of the dive door extends outwardly from the boat. In the closed position, the outer surface of the dive door matches the profile of the gunwale, providing a sleek integrated look. A ladder may be hinged to the dive door and is configured to extend downward into the water surface when the door is deployed.

U.S. Pat. No. 9,927,520 discloses a method of detecting a collision of the marine vessel, including sensing using distance sensors to determine whether an object is within a predefined distance of a marine vessel, and determining a direction of the object with respect to the marine vessel. The method further includes receiving a propulsion control input at a propulsion control input device, and determining whether execution of the propulsion control input will result in any portion of the marine vessel moving toward the object. A collision warning is then generated.

U.S. Pat. No. 10,106,227 discloses a bulwark terrace with integrated door. The bulwark terrace is a portion of a bulwark on a ship or yacht which is hinged so as to be able to fold outwards and downwards and be flush with the deck after doing so, thereby extending the deck surface. The bulwark terrace also includes a door which may open independently of the bulwark terrace to allow boarding of the yacht or ship through the bulwark without deploying the bulwark terrace.

U.S. Pat. No. 10,259,555 discloses a method for controlling movement of a marine vessel near an object, including accepting a signal representing a desired movement of the marine vessel from a joystick. A sensor senses a shortest distance between the object and the marine vessel and a direction of the object with respect to the marine vessel. A controller compares the desired movement of the marine vessel with the shortest distance and the direction. Based on the comparison, the controller selects whether to command the marine propulsion system to generate thrust to achieve the desired movement, or alternatively whether to command the marine propulsion system to generate thrust to achieve a modified movement that ensures the marine vessel maintains at least a predetermined range from the object. The marine propulsion system then generates thrust to achieve the desired movement or the modified movement, as commanded.

U.S. Pat. No. 11,403,955 discloses a propulsion control system on a marine vessel that includes at least one propulsion device configured to propel the marine vessel and at least one proximity sensor system configured to generate proximity measurements describing a proximity of an object with respect to the marine vessel. The system further includes a controller configured to receive proximity measurements, access a preset buffer distance, and calculate a velocity limit in a direction of the object for the marine vessel based on the proximity measurements and the preset buffer distance so as to progressively decrease the velocity limit as the marine vessel approaches the preset buffer distance from the object.

U.S. Pat. No. 11,600,184 discloses a method of controlling a propulsion system on a marine vessel includes receiving proximity measurements describing locations of one or more objects with respect to the marine vessel, receiving a command vector instructing magnitude and direction for propulsion of the marine vessel with respect to a point of navigation for the marine vessel, and then determining a funnel boundary based on the command vector. When an object is determined to be within the funnel boundary, a propulsion adjustment command is calculated to move the marine vessel such that the object is no longer in the funnel boundary. At least one propulsion device is then controlled based on the propulsion adjustment command.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the disclosure, a propulsion control system includes at least one marine drive configured to propel the marine vessel, a proximity sensor system configured to measure proximity of objects in a marine navigation area around the marine vessel to generate proximity measurements, and a control system. The control system is configured detect that an extendable element on the marine vessel is in an extended position, define an extended buffer zone around the marine vessel based on the extended position of the extendable element, and control the at least one marine drive based on the proximity measurements and the extended buffer zone to avoid the objects in the marine navigation area from entering the extended buffer zone.

In one embodiment, the extended buffer zone is larger in at least one dimension than a non-extended buffer zone defined when the extendable element is not in the extended position.

In another embodiment, the extended buffer zone is an area adjacent to the marine vessel having a shape and dimensions and the extended buffer zone is larger in at least one of the dimensions.

In another embodiment, the extendable element is configured to extend from a side of the marine vessel when in the extended position, and wherein the extended buffer zone is wider than the non-extended buffer zone defined when the extendable element is not in the extended position.

In another embodiment, the extendable element is configured to extend from a stern of the marine vessel when in the extended position, and wherein the extended buffer zone is longer than the non-extended buffer zone defined when the extendable element is not in the extended position.

In another embodiment, the extended buffer zone is configured to extend at least a predetermined buffer distance around the extended element in the extended position.

In another embodiment, the extendable element is a folding gunwale configured to extend from a side of the marine vessel when in the extended position.

In another embodiment, the system further includes at least one sensor configured to output sensor information indicative of whether the extendable element is in the extended position, wherein the control system is configured to detect that the extendable element is in the extended position based on the sensor information.

In another embodiment, the control system is configured to detect that the extendable element is extended based on data from the proximity sensor system.

In another embodiment, the proximity sensor system includes at least one sensor configured to image an area of the marine vessel comprising the extendable element and generate perception data showing the area of the marine vessel, wherein the control system is configured to detect that the extendable element is in the extended position based on the perception data.

In another aspect of the disclosure, a method for propulsion control for a marine vessel includes measuring proximity of objects around the marine vessel via a proximity sensor system to generate proximity measurements, detecting that an extendable element on the marine vessel is in an extended position, defining an extended buffer zone around the marine vessel with a control system based on the extended position of the extendable element, and controlling at least one marine drive with the control system based on the proximity measurements and the extended buffer zone to avoid the objects in the marine navigation area entering the extended buffer zone.

In one embodiment, the extended buffer zone is larger in at least one dimension than a non-extended buffer zone defined when the extendable element is not in the extended position.

In another embodiment, the extendable element extends from a side of the marine vessel when in the extended position, and wherein the extended buffer zone is wider than the non-extended buffer zone defined when the extendable element is not in the extended position.

In another embodiment, the extendable element extends from a stern of the marine vessel when in the extended position, and wherein the extended buffer zone is longer than the non-extended buffer zone defined when the extendable element is not in the extended position.

In another embodiment, the extended buffer zone is defined to extend at least a predetermined buffer distance around the extended element in the extended position.

In another embodiment, the extendable element is a folding gunwale or portion of a vessel sidewall that extends from a side of the marine vessel when in the extended position.

In another embodiment, the extendable element is a gangplank, at least one davit, a movable swim platform that extends from a side or a stern of the marine vessel when in the extended position.

In another embodiment, the method includes operating at least one sensor to output sensor information indicative of whether the extendable element is in the extended position, wherein the detection that the extendable element is in the extended position is based on the sensor information.

In another embodiment, the detection that the extendable element is in the extended position is based on data from the proximity sensor system.

In another embodiment, the method includes operating the proximity sensor system to image an area of the marine vessel comprising the extendable element and generate perception data showing the area of the marine vessel, and detecting that the extendable element is in the extended position based on the perception data.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

The present disclosure relates to systems and methods for controlling propulsion of a marine vessel, and more specifically to propulsion control systems and methods that define and/or adjust a buffer zone of a marine vessel based on one or more extendable elements connected to the marine vessel. The inventors have recognized that current marine navigation systems are inadequate for enabling object avoidance in certain situations, such as when the marine vessel is equipped with extendable elements that temporarily extend the size and dimensions of the marine vessel. Failing to account for these extendable elements when autonomously or semi-autonomously controlling propulsion of the vessel may result in damage to the marine vessel, other nearby vessels, and/or damage to potential docking locations. Extendable elements include any device or system that is movable and configured to extend outside the normal footprint of the vessel, such as a gangplank, at least one davit, a movable swim platform, a folding gunwale, or other portion or door of the vessel sidewall or stern configured to fold or otherwise extend outward. Exemplary extendable elements and vessels having such extendable elements are shown and described at U.S. Pat. Nos. 9,120,540, 10,106,277, and U.S. application Ser. Nos. 17/350,333, 17/963,782, and 18/122,386, which are each hereby incorporated by reference herein in their entirety.

The inventors have recognized that improved marine propulsion systems and control methods are needed that define and/or adjust buffer zones as an area adjacent to the marine vessel that accounts for extendable elements in an extended position. Extending the buffer zone enables the navigation control system to account for the extendable element, enabling additional time and distance to respond to object detection. Accordingly, the inventors developed the disclosed system and a method for propulsion control configured to define and/or adjust the buffer zone based on the detection of the extension of one or more extendable devices. The control system then automatically controls at least one marine drive based on proximity measurements by a proximity sensor system and the extended buffer zone for object avoidance such that no object in the marine navigation area enters or remains in the extended buffer zone.

Figure 1:
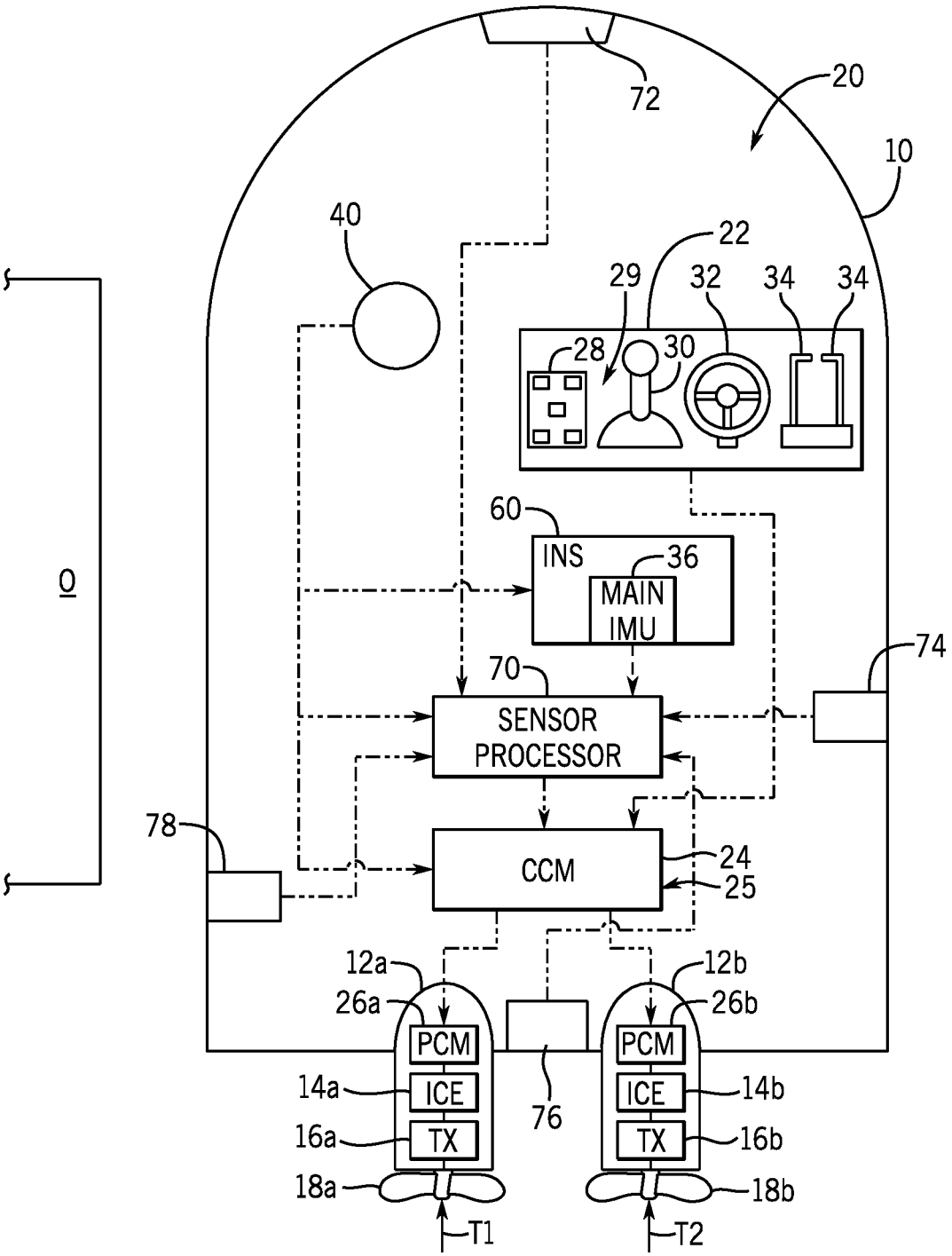
FIG. 1 is a schematic representation of an exemplary propulsion system on a marine vessel.

FIG. 1 shows a marine vessel 10 equipped with a propulsion control system 20 on a marine vessel 10 configured according to one embodiment of the disclosure. The propulsion control system 20 is capable of operating, for example, in a joysticking mode where a joystick is operated by a user to control vessel movement within an x/y plane, among other modes, as described hereinbelow. Additionally or alternatively, the propulsion control system 20 may be configured to include and execute autonomous navigation, wherein the autonomous navigation may replace or supplement navigation control determined by user input. The propulsion system 20 has first and second marine drives 12*a*, 12*b* that produce first and second thrusts T1, T2 to propel the vessel 10. The first and second marine drives 12*a*, 12*b* are illustrated as outboard motors, but they could alternatively be inboard motors, stern drives, jet drives, or pod drives. Each marine drive is provided with a powerhead, such as an electric motor 14*a*, 14*b* operatively connected to a transmission 16*a*, 16*b*, in turn, operatively connected to a propulsor 18*a*, 18*b*, herein illustrated as a propeller. In other embodiments, the powerhead may be an internal combustion engine electric motor (e.g., powered by a battery or other power storage system) or a hybrid system comprising one or more of an electric motor and an internal combustion engine configured to initiate rotation of the propulsor.

The vessel 10 also houses various control elements that comprise part of the propulsion control system 20—i.e., a control system comprising at least one controller and in some embodiments comprising multiple controllers communicatively connected and configured to execute the functions described herein. The system 20 in FIG. 1 comprises an operation console 22 in signal communication, for example via a CAN bus as described in U.S. Pat. No. 6,273,771, with a controller 24, such as a command control module (CCM), and with propulsion control modules (PCM) 26*a*, 26*b* associated with the respective marine drives 12*a*, 12*b*. Each of the controller 24 and the PCMs 26*a*, 26*b* may include a memory 25*a* and a programmable processor 25*b*. As is conventional, each control module 24, 26*a*, 26*b* includes a processor communicatively connected to a storage system comprising a computer-readable medium that includes volatile or nonvolatile memory upon which computer readable code and data is stored. The processor can access the computer readable code and, upon executing the code, carries out functions, such as the navigation control functions and/or the proximity sensing calibration functions, as described in detail below.

The operation console 22 includes a number of user input devices, such as a keypad 28, a joystick 30, a steering wheel 32, and one or more throttle/shift levers 34. Each of these devices inputs commands to the controller 24. The controller 24, in turn, communicates control instructions to the first and second marine drives 12*a*, 12*b* by communicating with the PCMs 26*a*, 26*b*. The steering wheel 32 and the throttle/shift levers 34 function in a conventional manner, such that rotation of the steering wheel 32, for example, activates a transducer that provides a signal to the controller 24 regarding a desired direction of the vessel 10. The controller 24, in turn, sends signals to the PCMs 26*a*, 26*b* (and/or TVMs or additional modules if provided), which in turn activate steering actuators to achieve desired orientations of the marine drives 12*a*, 12*b*. The marine drives 12*a*, 12*b* are independently steerable about their steering axes. The throttle/shift levers 34 send signals to the controller 24 regarding the desired gear (forward, reverse, or neutral) of the transmissions 16*a*, 16*b* and the desired rotational speed of the powerheads 14*a*, 14*b* of the marine drives 12*a*, 12*b*. The powerhead 14*a*, 14*b* initiates rotation of the propulsor 18*a*, 18*b* and in various embodiments may be an internal combustion engine, an electric motor driven by a battery, or other power storage device, or may be a hybrid electric system comprising both an ICE and an electric motor. The controller 24, in turn, sends signals to the PCMs 26*a*, 26*b*, which in turn activate electromechanical actuators in the transmissions 16*a*, 16*b* and powerheads 14*a*, 14*b* for shift and throttle, respectively. A manually operable input device, such as the joystick 30, can also be used to provide control input signals to the controller 24. The joystick 30 can be used to allow the operator of the vessel 10 to manually maneuver the vessel 10, such as to achieve lateral translation or rotation of the vessel 10.

The propulsion control system 20 also includes one or more proximity sensors 72, 74, 76, and 78. Although the proximity sensor system is shown as comprising one proximity sensor on each of the bow, stern, and port and starboard sides of the vessel 10, fewer or more sensors could be provided at each location and/or provided at other locations, such as on the hardtop of the vessel 10 (as illustrated by sensor 79*a* in FIG. 4). The proximity sensors 72-78 are distance and directional sensors. For example, the sensors could be radars, sonars, cameras, lasers (e.g. LIDARs or Leddars), Doppler direction finders, or other devices individually capable of determining both the distance and direction (at least approximately), i.e. the relative position of an object O with respect to the vessel 10, such as a dock, a seawall, a slip, another vessel, a large rock or tree, etc. The sensors 72-78 provide information regarding both a direction of the object with respect to the marine vessel 10 and a shortest distance between the object O and the vessel 10. Alternatively, separate sensors could be provided for sensing direction than are provided for sensing distance, or more than one type of distance/direction sensor can be provided at a single location on the vessel 10. The sensors 72-78 provide this distance and/or direction information to one or more control modules, such as to the sensor processor 70 and/or the control module 24, such as by way of a dedicated bus connecting the sensors to a controller, a CAN bus, or wireless network transmissions, as described in more detail below. The proximity sensors 72, 74, 76, and 78 may be configured to image portions of the vessel, such as some or all of the outer edge of the vessel 10. Thereby, the proximity sensing system is configured to capture objects attached to and/or extending from the vessel.

Regarding the proximity sensors, 72, 74, 76, 78, note that different types of sensors may be used depending on the distance between the vessel 10 and the object O. For example, radar sensors may be used to detect objects at further distances. Once the vessel 10 comes within a particular distance of the object, LIDAR, ultrasonic, LEDDAR, or sonar sensors may instead be used. Camera sensors may be used, alone or in combination with any of the sensors mentioned above, to provide object proximity information to the control module 24. Sensors are placed at positions on the vessel 10 so that they are at the correct height and facing direction to detect objects the vessel 10 is likely to encounter. Optimal sensor positions will vary depending on vessel size and configuration.

In FIG. 1, the proximity sensors are positioned at each of the front, sides, and stern of the vessel 10, and include front-facing sensor 72, starboard-facing sensor 74, rear-facing sensor 76, and port-facing sensor 78. In a different exemplary sensor arrangement, two proximity sensors may be placed on the hard top of the marine vessel 10 and arranged such that the fields of view of the two sensors, combined, cover the entire 360° area surrounding the vessel 10. Note also that the relevant controller, such as the sensor processor 70, may selectively operate any one or more of a plurality of sensors (including radars, LIDARs, LEDDARs, ultrasonics, and cameras) to sense the shortest distance and the direction of the object with respect to the vessel 10. Alternatively, the sensor processor may use all available perception data from all sensor types, which may be reviewed real time as it is received or may be formulated into one or more maps or occupancy grids integrating all proximity measurement data, where the mapped data from all the operated sensors is processed as described herein. In such an embodiment, the proximity measurements from each of the various sensors are all translated into a common reference frame.

Autonomous and/or advanced operator assistance (i.e., semi-autonomous) controls for improved vessel handling qualities requires placement of multiple proximity sensors on the vessel 10. In general, these various types of proximity sensing devices (examples described above) are positioned to detect the presence of objects in the marine environment surrounding the marine vessel 10, such as a dock, swimmer, or other obstruction in the path of the vessel. The sensors may also be configured to capture portions of the vessel, such as portions of the outer edge of the vessel. The control system may receive image data or proximity data described above, from the sensors that includes at least a partial image or proximity measurements of a portion of the marine vessel. The control system may define the vessel size and/or shape. This may include extendable elements attached to the marine vessel, such as an extended gangplank, a davit, a moveable swim platform, a folding gunwale, or other foldable or extendable element configured to extend outward from the vessel. The proximity sensors may detect whether or not the one or more extendable elements are in an extended position and define the shape and/or size of the marine vessel accordingly.

In some embodiments, each sensor reports proximity relative to its own frame of reference—i.e. the distance from the sensor to the object as measured along the view angle of the sensor. Depending on the type of sensor, the application of use, boat size, hull shape, etc., multiple sensor types and sensor locations may be required to provide adequate proximity sensing around the marine vessel 10 for operation in all marine environments. To create a cohesive dataset that can be used for purposes of vessel control and vessel navigation, including autonomous vessel navigation and semi-autonomous control (such as automatic maneuver-limiting control), all of the data sources are preferably translated to a common reference frame. This may require knowledge of the location and orientation of each sensor relative to the common reference frame such that the data measured therefrom can be translated appropriately.

In the example of FIG. 1, a main inertial measurement unit (IMU) 36 is installed at a known location on the marine vessel with respect to a predefined point of navigation, such as the center of rotation (COR) or center of gravity (COG). The installation orientation or the main IMU 36 is also known. The installation locations of the main IMU 36 and each proximity sensor 72-78 are established as part of a calibration procedure for the proximity sensing system.

Referencing the example in FIG. 1, the main IMU 36 may be part of an inertial navigation system (INS) such as including one or more micro-electro-mechanical systems (MEMS). For example, the INS 60 may consist of a MEMS angular rate sensor, such as a rate gyro, a MEMS accelerometer, and a magnetometer. Such INS systems are well known in the relevant art. In other embodiments, the motion and angular position (including pitch, roll, and yaw) may be sensed by a differently configured INS 60, or by an attitude heading reference system (AHRS) that provides 3D orientation of the marine vessel 10 by integrating gyroscopic measurements, accelerometer data, and magnetometer data.

The INS 60 receives orientation information from the main IMU 36 and may also receive information from a GPS receiver 40 comprising part of a global navigation satellite system (GNSS), which here is a global positioning system (GPS). The GPS receiver 40 is located at a pre-selected fixed position on the vessel 10, which provides information related to global position of the marine vessel 10. The main IMU 36 is also located at a known and fixed position with respect to the center of navigation determined for the marine vessel 10, such as the COR or COG.

The inventors have recognized unique problems presented by autonomous and semi-autonomous vessel control systems for operating in marine environments where marine vessels additional degrees of freedom compared to automotive applications—i.e., they can effectuate only lateral and yaw movement without any forward or reverse movement (e.g., in a joysticking mode). Additionally, marine environments pose unique external environmental factors acting on the marine vessel, such as current, wind, waves, or the like.

The inventors have recognized that the above-mentioned operational challenges posed by a marine environment can be effectively dealt with by defining and maintaining a buffer distance around the marine vessel, where the control authority provided to a user and/or the propulsion controller is limited based on the buffer distance. For example, the propulsion control system may continuously calculate a maximum velocity, or velocity limit, for the marine vessel as it approaches an object O, and may limit authority in controlling propulsion of the marine vessel 10 such that the propulsion system will not effectuate a thrust that will cause the marine vessel to travel toward the object at a velocity that is greater than the velocity limit. Thus, the propulsion system does not respond to, or carry out, commands that would cause the vessel to violate the buffer distance and venture too close to an object. In certain embodiments, the propulsion control system may be configured to automatically maintain a predetermined buffer distance between the marine vessel 10 and an object O, such as to automatically effectuate propulsion controls in order to force the marine vessel 10 away from a marine object O when the buffer zone is violated.

The control system may be configured to utilize relevant vessel velocity or acceleration limits to set the buffer distances defined by a buffer zone and thus to avoid colliding with obstacles. Based on the acceleration limit and the distance range to obstacles, the control system can determine a maximum vessel velocity that can be realized to avoid colliding with known obstacles. The acceleration limit is the maximum acceleration a vessel can reach for both speeding up and slowing down, where maximum deceleration of a marine vessel is accomplished by effectuating a maximum acceleration opposite the direction of travel of the marine vessel.

Figure 2:
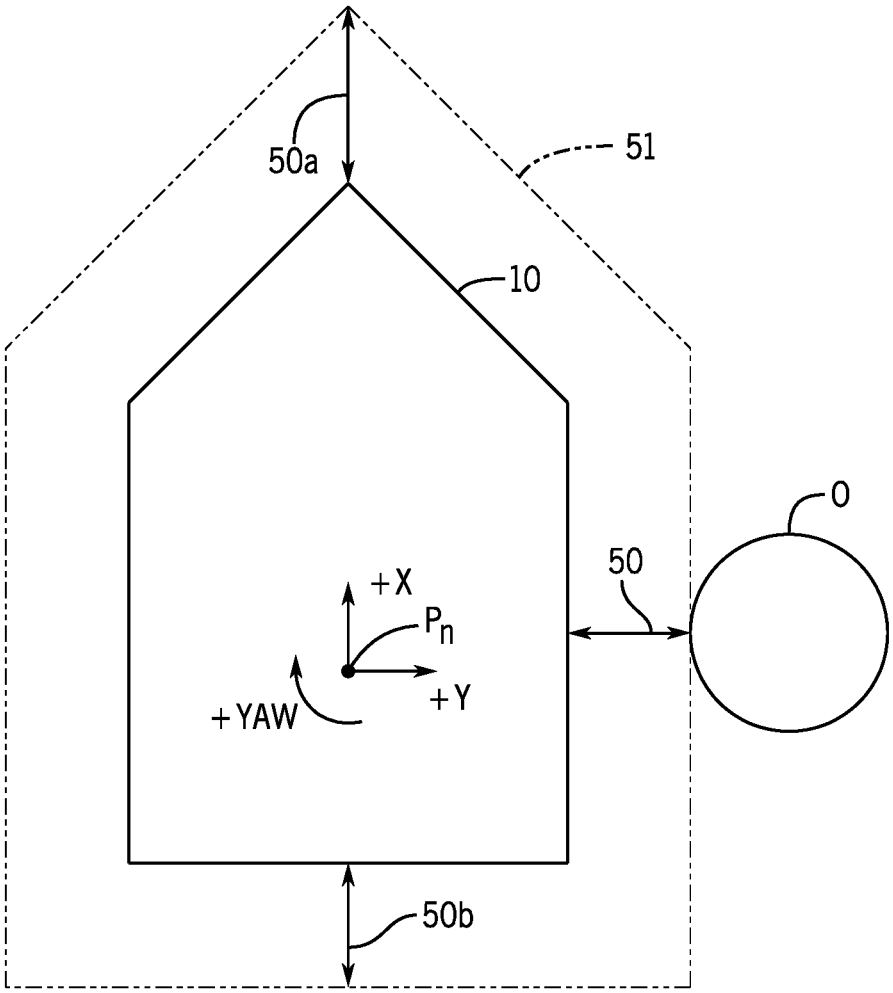
FIG. 2 schematically illustrates one implementation of a buffer distance maintained between a marine vessel and an object according to one embodiment of the present disclosure.

FIG. 2 is a diagram exemplifying this concept, where the marine vessel 10 is maintained at least the predetermined buffer distance 50 from the object O. A buffer zone 51 around the marine vessel 10 is defined, and velocity limits are calculated to progressively decrease the vessel velocity as it approaches the buffer distance 50 from the object O. In the depicted embodiment, the buffer zone 51 is established at a preset buffer distance 50 that may be defined based on whether one or more extendable elements are in an extended position, wherein the buffer zone is an area adjacent to the marine vessel having a shape and dimensions. In various embodiments, the buffer distances on different sides of the vessel may be the same as or differ from one another. For example, a buffer distance on the starboard and port sides of the marine vessel 10 may be set the same or different than the buffer distances 50*a*, 50*b*, as disclosed in greater detail below. As another example, the buffer zone 51 may define different buffer distances on each of the port side and starboard side, such as to accommodate an extended element one side of the vessel.

The control system may be configured to generate proximity measurements, such as with respect to the buffer distance 50*a*, 50*b*, to describe the proximity of objects in the marine environment around the vessel. Exemplary proximity sensing methods and systems are shown and described in U.S. Pat. No. 11,403,955, which is incorporated by reference above. The system further includes a controller configured to receive proximity measurements, access a buffer distance, and calculate a velocity limit in a direction of the object for the marine vessel based on the proximity measurements and the buffer distance so as to progressively decrease the velocity limit as the marine vessel approaches the buffer distance from the object.

Figure 3A:
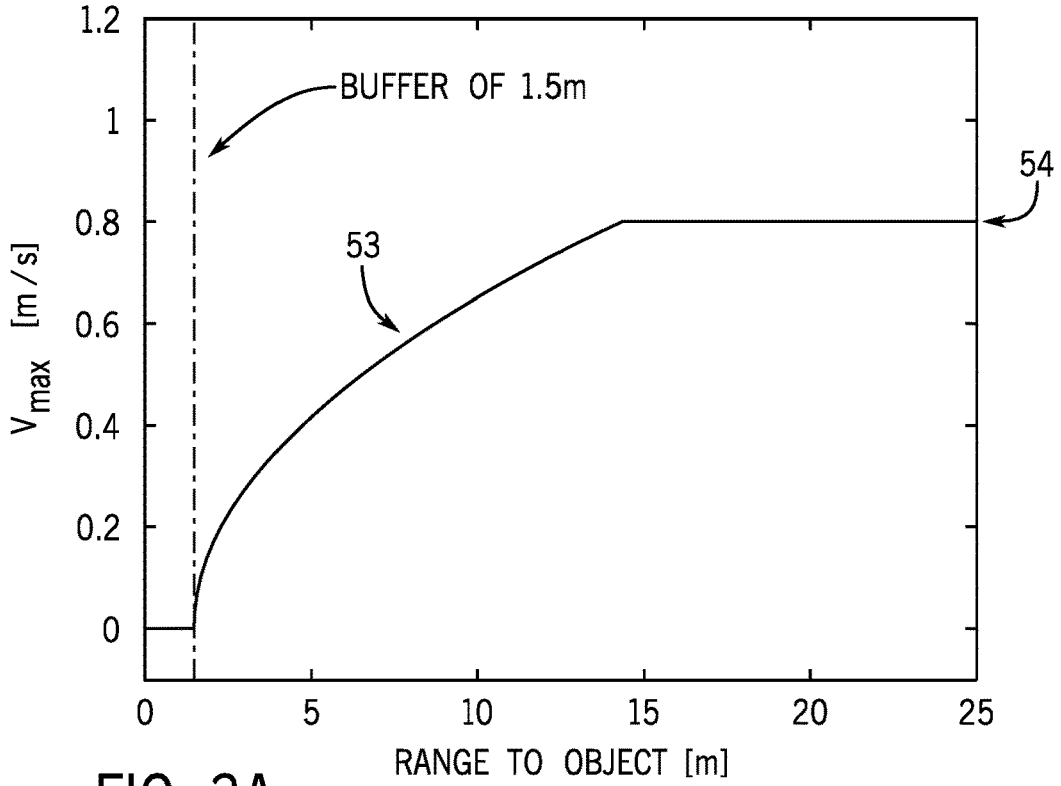
FIGS. 3A and 3B are graphs showing exemplary velocity limit ranges for an exemplary buffer distance of 1.5 meters.
Figure 3B:
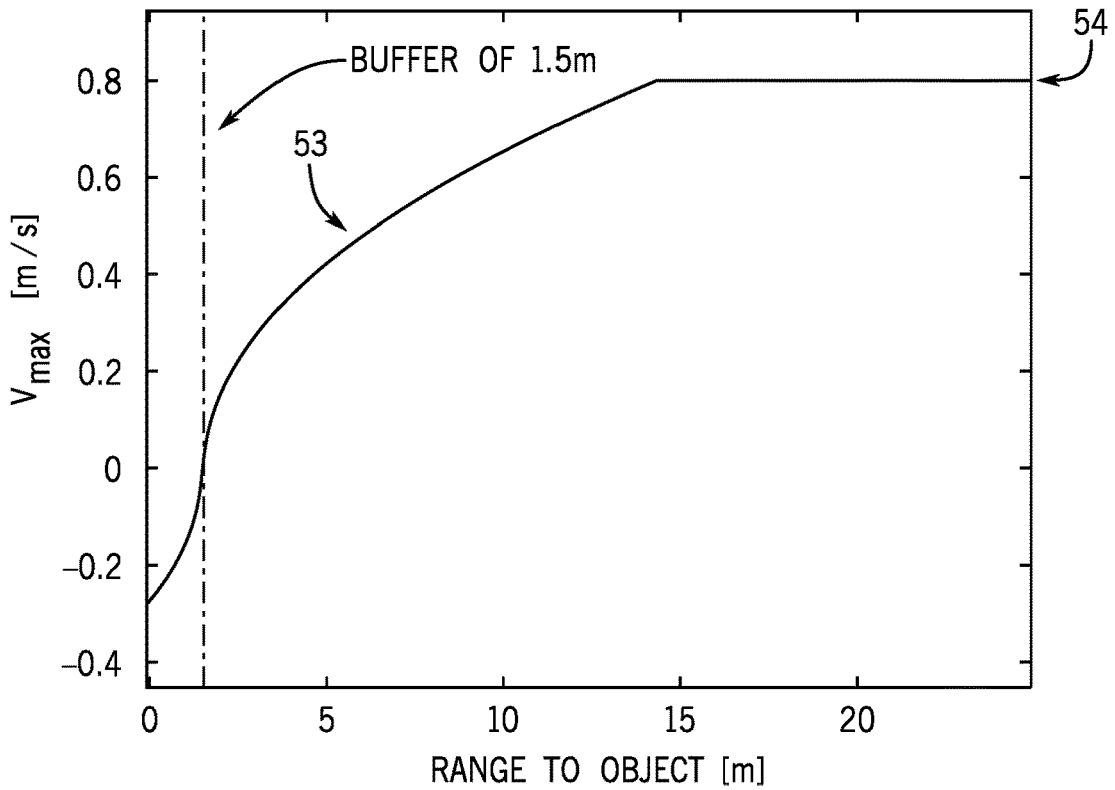

FIGS. 3A and 3B are graphs depicting the velocity limit with respect to object distance for exemplary control scenarios where the buffer distance 50 around the marine vessel 10 is 1.5 meters. The velocity limit 53 decreases as the marine vessel 10 approaches the object O. User authority may be limited such that user control input (e.g. via the joystick) to move the marine vessel 10 in the direction of the object will not be acted upon by the propulsion system 20. In other embodiments, the velocity limit 53 may be zero at the buffer distance 50 and then become negative once the distance to the object O is less than the buffer distance. Accordingly, no thrust will be provided in the direction of the object O if the marine vessel is less than or equal to the buffer distance 50 from the object O, even if the user provides input (such as via the joystick 30) instructing movement in the direction of the object O. In the scenario in FIG. 3B, the control system may be configured such that the negative velocity limit 53 is converted to a control command to effectuate a thrust away from the object O so that the marine vessel 10 is maintained at least the buffer distance 50 away from the object O.

The shape and dimensions of the buffer zone may be modified to optimize autonomous navigation or semi-autonomous driver assistance control functions. The size and shape of the buffer zone may include a predetermined minimum buffer distance that may be increased in one or more directions as one or more extendable elements are identified as being in an extended position, which in some embodiments may include a partial extended position. In one embodiment, the control system is configured to define the shape and the dimensions of the buffer zone with respect to a center of navigation for the marine vessel. As described previously, the center of navigation may be a known location on the marine vessel with respect to a predefined point of navigation, such as the center of rotation (COR), the center of gravity (COG), or the center of turn.

Using the known distances between the proximity sensors established as part of the sensor system configuration and objects detected within the proximity data, including the edge of the marine vessel, the control system may use the shape and dimensions of the hull of the marine vessel to determine the shape and dimension of the buffer zone. In other embodiments, the shape and dimensions of the vessel with respect to the point of navigation may be defined and stored at the time of installation or calibration of the propulsion control system. The shape and dimensions of the buffer zone may be the same as or may differ from the shape and proportions of the hull with respect to a center of navigation for the marine vessel.

The shape and dimensions of the buffer zone may be modified based on the detection of one or more extendable elements being in an extended position to optimize autonomous navigation or semi-autonomous driver assistance control functions for the modified vessel shape that includes the extended element. The shape and dimensions of the extended buffer zone may follow the shape of the vessel with the extended element, or may differ therefrom. Examples and shown and described herein. Where the shape and dimensions of the buffer zone are predetermined and stored, the shape and dimensions of the extended buffer zone may also be predetermined and stored. Where the edge of the vessel and/or the buffer zone is determined based on perception data from the proximity sensing system, the extended buffer zone may be defined based on the edge of the extended element detected in the perception data.

The shape and dimensions of the non-extended and/or extended buffer zone may be defined with respect to the shape and dimensions of the hull of the marine vessel. In embodiments with image systems, the edge of the marine vessel may be visible within the view of the image sensors connected to the image system. The control system may identify any extendable elements in the received perception data and determine whether they are in an extended position. The control system may layer perception data, such as proximity and/or image data, received from the proximity or image sensors with a mask that defines what portions within the received perception data are the marine vessel and which portions of the image are not part of the vessel. For example, the control system may be configured to define a point cloud based on the perception data and may compare the point cloud to a predefined 3D vessel profile of the vessel. Objects or aspects of the point cloud that extend outside of the vessel may be identified as extendable objects. In certain embodiments, the control system may be configured to monitor the comparison of the 3D vessel profile and the perception data and/or the point cloud over time to identify extendable objects as objects that extend outside of the 3D vessel profile and also persist with the imaged portion of the vessel over the analyzed time period.

The control system may be configured to adapt at least one dimension of the buffer zone in an area proximate to the area of the marine vessel comprising the extendable element. The control system may detect a cause for adaptation of the buffer zone based on extension of, or a change in the extended position of, the extendable element. In embodiments where a change in more than one extendable element is detected, the control system may define a first dimension of the extended buffer zone based on the first extendable element and define a second dimension of the extended buffer zone based on the second extendable element, and define or adjust the buffer zone to be the largest buffer distance in each direction occupied by either the first dimension or the second dimension of the extended buffer zone. Likewise, the control system may define a plurality of buffer distances based on the extended position of a plurality of different extendable elements and define or adjust the buffer zone to be the largest buffer distance in each direction of the plurality of buffer distances.

Figure 4:
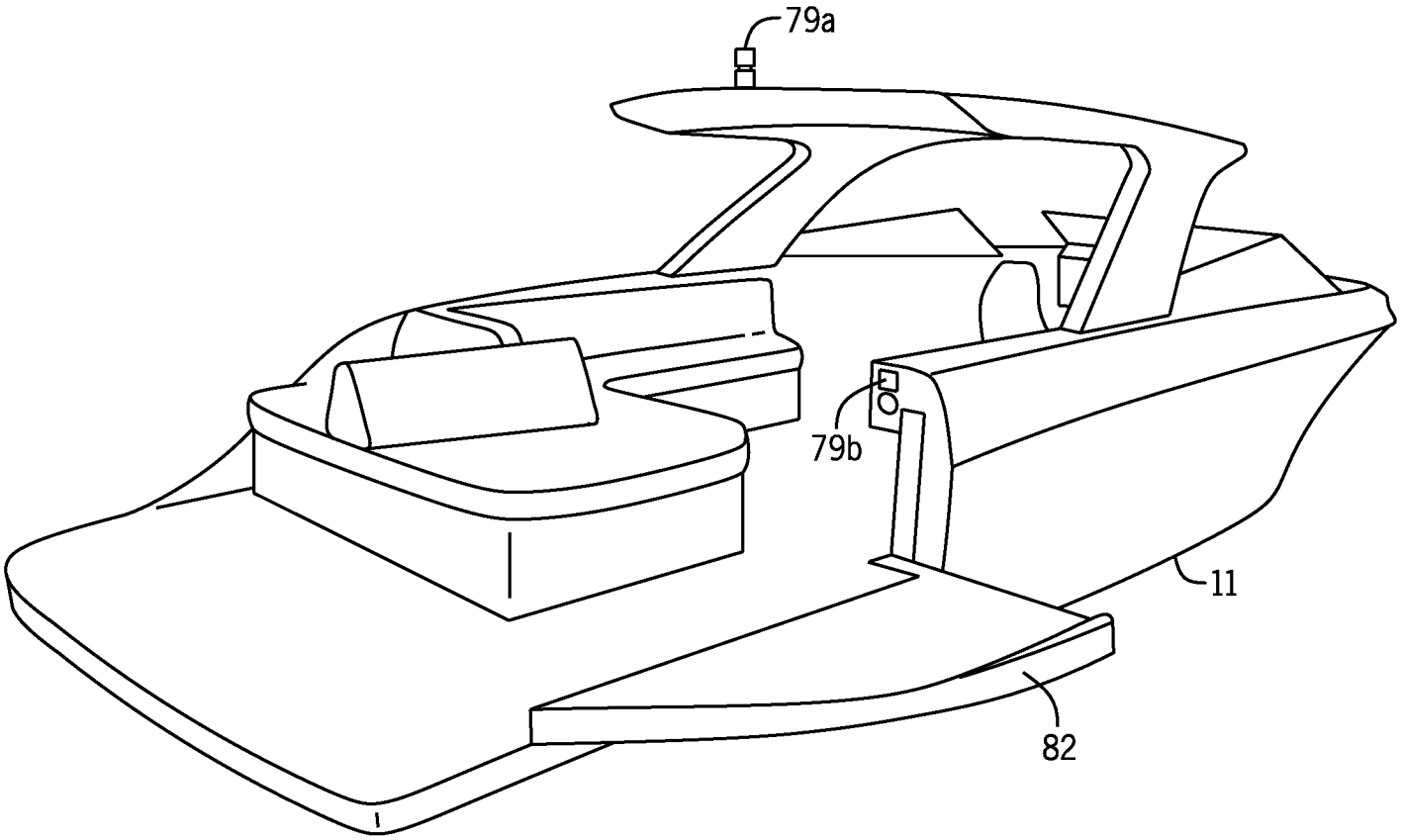
FIG. 4 illustrates a marine vessel with an extendable element being a folding gunwale, according to embodiments of the disclosure.

Referring now to FIG. 4, when an extendable element on the marine vessel, such as the folding gunwale illustrated, is in an extended position, the control system may define an extended buffer zone around the marine vessel based on the extended position of the folding gunwale 82 and may control the at least one marine drive based on the proximity measurements. The extended buffer zone may be larger in at least one dimension than the non-extended buffer zone that is defined when the extendable element is not extended.

In the illustrated embodiment, the folding gunwale 82 may be configured to extend from a side 11 of the marine vessel when in the extended position, wherein the side 11 of the marine vessel may either be from the starboard or the port side 11. The extendable element, here the folding gunwale, is configured to extend from a side 11 of the marine vessel such that it lies parallel or substantially parallel with the water surface when in the extended position, and to close flush with the side of the vessel when not in the extended position. In some embodiments, the folding gunwale may be motorized such that movement of the folding gunwale between the extended and non-extended, or closed, positions is controlled by a motor or actuator. When the folding gunwale is in the extended position, the extended buffer zone is defined to accommodate it and is thus wider than the non-extended buffer zone defined when the folding gunwale is not in the extended position. In some embodiments, the folding gunwale 82 may be extended on one or both sides; each side may be separately controllable or controlled together. The control system may be configured to adapt the buffer zone to accommodate the possible configurations for the marine vessel.

The control system may determine the extended position of the folding gunwale 82 by data received from one or more sensors 79*a*, 79*b*. The sensor(s) 79*a*, 79*b* may be configured to output sensor information indicative of whether the extendable element is in the extended position, wherein the control system is configured to detect that the extendable element is in the extended position based on the sensor information. The sensor 79*b* is located to sense whether the extendable element, here the folding gunwale 82, is extended. In one embodiment, the sensor 79*b* may include a switch configured to open or close when the extendable element leaves the closed position. The output sensor 79*b* may be digital or analog. For example, the sensor 79*b* may transmit data in binary (e.g., 1 or 0 for open or not open) or may be a multi-position sensor. In some embodiments, the sensor 79*b* may be configured to sense a position of the extendable element anywhere between and including each of the closed and fully extended position. The sensor may be configured to detect and convey the precise position of the extendable element, such as rotational position information or longitudinal position information, such as from an encoder sensor. Additionally or alternatively, the sensor 79*b* may sense a position of a rotational element associated with the extendable element, such as a motor or axle or linear actuator, or it may be a position of a longitudinally extendable device. For instance, the sensor may be located on a track or telescoping portion of the extendable element, such as illustrated by the sensor 79*c* attached to the telescoping portion of the gangplank 84 in FIG. 5.

Referring again to FIG. 4, the proximity sensor system includes at least one sensor 79*a* configured to image an area of the marine vessel comprising the extendable element and generate perception data showing the area of the marine vessel, wherein the control system is configured to detect that the extendable element is in the extended position based on the perception data. The control system may identify the extended position of the folding gunwale from perception data received from the sensor 79*a*, which may comprise part of the proximity sensing system described above, such as identifying the side or rear portion(s) of the marine vessel where extendable elements are located. For example, the sensor(s) 79*a* may be a single lens camera, a stereovision camera, a LIDAR, LEDDAR, etc. positioned such that its field of view (FOV) captures the entire extendable element in its extended position, and/or captures positions between the fully retracted position and the fully extended position. Similarly, the control system may be configured to detect intermediary positions between the fully extended and fully retracted positions and, in some embodiments, the buffer zone may be adapted accordingly. For example, the control system may be configured to detect extension of the extendable element based on comparison of a point cloud generated based on the perception data compared to a vessel profile, as described above. Alternatively, the control system may store and utilize one or more computer vision machine learning (CVML) models trained to detect extension of the extendable element(s). For example, the CVML model(s) may be trained based on perception data, such as image data, depth information, and/or other proximity data, from the sensor 79*a* (or approximating the sensor FOV) showing the vessel with the extendable element in the extended position.

Figure 6:
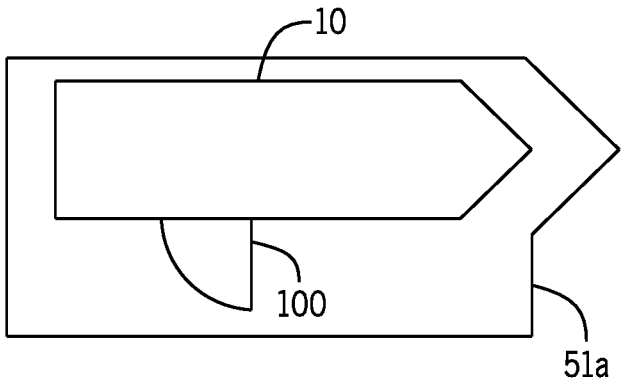
FIGS. 6 and 7 illustrates an exemplary extendable element extending from a side of a marine vessel in an extended position with an extended buffer zone adapted thereto, according to embodiments of the disclosure.
Figure 7:
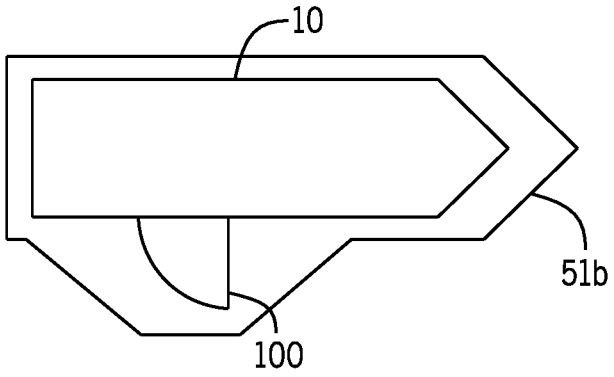

As illustrated in FIG. 6, the control system may define the extended buffer zone by uniformly extending the relevant side of the buffer zone, which may be by a predetermined amount sufficient to include the entire extendable element 100 within the extended buffer zone 51*a*. For example, the control system may adapt at least one dimension of the buffer zone 51*a* according to the length of the extendable element in its extended position. Alternatively, as illustrated in FIG. 7, the control system may define the extended buffer zone 51*b* to follow the general shape of the extendable element or to otherwise taper around the extendable element such that it extends at least a predetermined buffer distance around the extended element 100 in the extended position. In the example at FIG. 7, the extended buffer distance tapers on either side of the extendable element 100 so as to provide a smooth line, which in some implementations may be efficient for navigating around objects smoothly. Thus, here the extended buffer zone 51*b* adjusts only a portion of one side of the buffer zone 51*b* where the extended element 100 is situated, and the buffer zone tapers on either side of the extended element 100 to the normal buffer distance, such as the minimum buffer distance.

Figure 5:
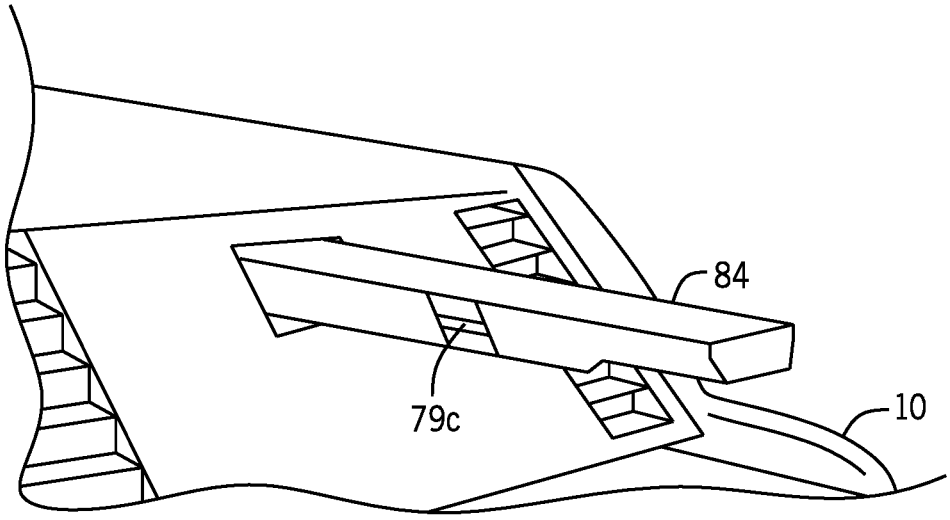
FIG. 5 illustrates a marine vessel with an extendable element being a gangplank, according to embodiments of the disclosure.

In another embodiment, the control system may identify partial extended positions of an extendable element within the proximity data or image data, such as the partial extension of a gangplank 101, as illustrated in FIG. 5. When identifying a partial extended position, the control system may adapt the size and/or dimensions of the extended buffer zone according to the partially extended position. For example, the partially extended position may be determined based on perception data from one or more sensors 79*b*. For example, the control system may be configured to access a stored set of dimensions (e.g., widths and/or lengths) of the extendable element 101 at a plurality of positions that may be sensed by the sensor(s) 79*b*. Alternatively, the control system may be configured to determine the partially extended position based on perception data from the proximity or image sensor(s) 79*b*, such as to determine the current length and/or width of the extendable element 101 based on the proximity measurements of that element. The control system may then adjust the size and/or dimensions of the extended buffer zone 51*d* based on the current dimensions of the extendable element in its partially extended position, and may continue to adjust the buffer zone 51*d* as the partial extended position of the extendable element 101 changes.

Figure 8:
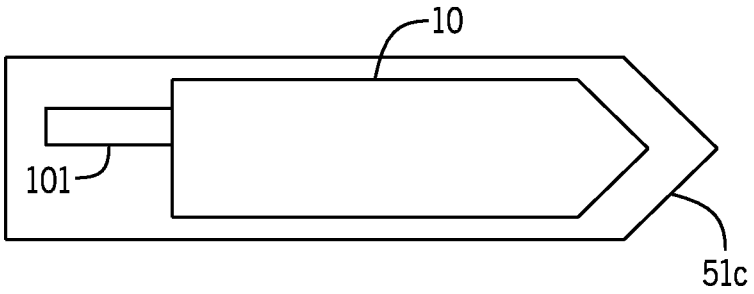
FIGS. 8 and 9 illustrates an exemplary extendable element extending from a stern of a marine vessel in an extended position with an extended buffer zone adapted thereto, according to embodiments of the disclosure.
Figure 9:
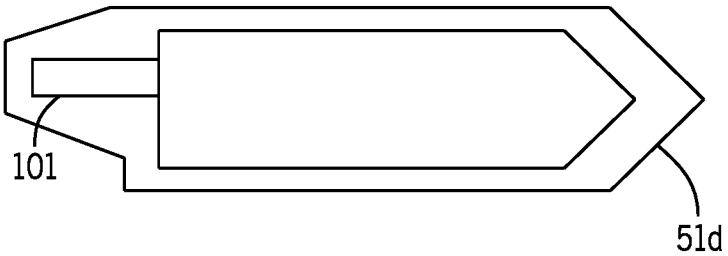

In embodiments such as the gangplank 101 illustrated in FIGS. 8 and 9, the extendable element may be configured to extend from the stern of the marine vessel 10. The extended buffer zone is defined accordingly such that it is longer in the bow-stern direction than the non-extended buffer zone defined when the extendable element is not in the extended position. As illustrated in FIG. 8, the control system may define the extended buffer zone 51*c* to include the extendable element 101 by extending a stern side of the buffer zone 51*d* by a predetermined buffer distance. Alternatively, as illustrated in FIG. 9, the control system may extend a portion of at least one side, or dimension, of the extended buffer zone 51*d* and to taper the buffer zone in correlation with the dimensions of the extendable element 101.

Figure 10:
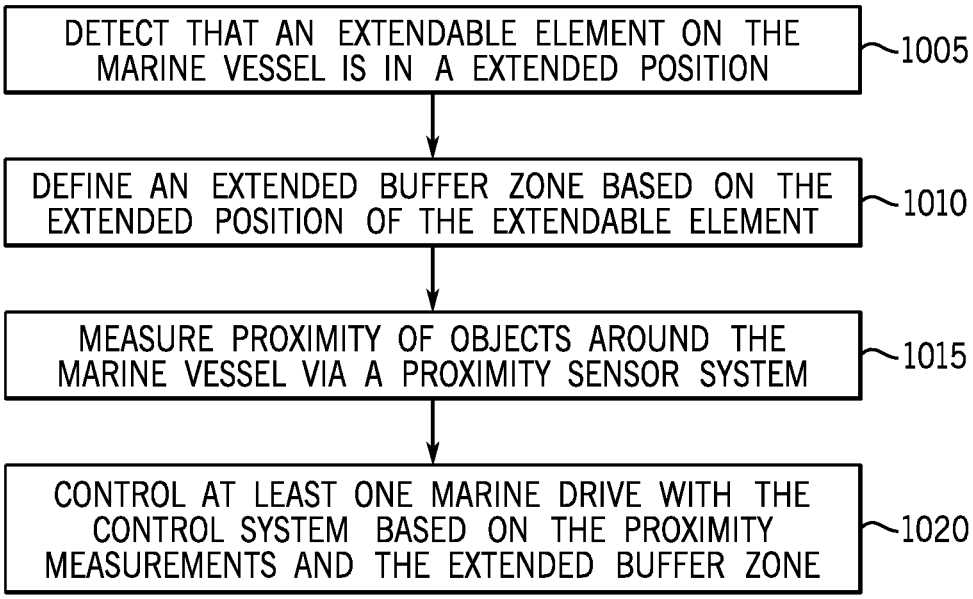
FIGS. 10-11 illustrate exemplary method steps for adapting a buffer zone and providing propulsion control according to embodiments of the disclosure.

Referring now to FIG. 10, an exemplary propulsion control method is illustrated. At 1005, the control system detects that an extendable element on the marine vessel is in an extended position. In one embodiment, the control system detects the extended position based on data received by a sensor positioned on or near the extendable object and configured to sense whether it is in the extended position. Alternatively or additionally, the control system may be configured to detect the extended position based on perception data from a proximity sensor and/or an image sensor. At 1010, an extended buffer zone is defined by the control system based on the extended position of the extendable element. In embodiments where the extended element is on the side of the marine vessel, the extended buffer zone is wider than the non-extended buffer zone defined when the extendable element is not in the extended position. In embodiments where the extended element is on the stern of the marine vessel, the extended buffer zone is longer than the non-extended buffer zone defined when the extendable element is not in the extended position. At 1015, the proximity of objects around the marine vessel is measured by the control system via a proximity sensor system. At 1020, at least one marine drive is controlled by the control system based on the proximity measurements and the buffer zone.

Figure 11:
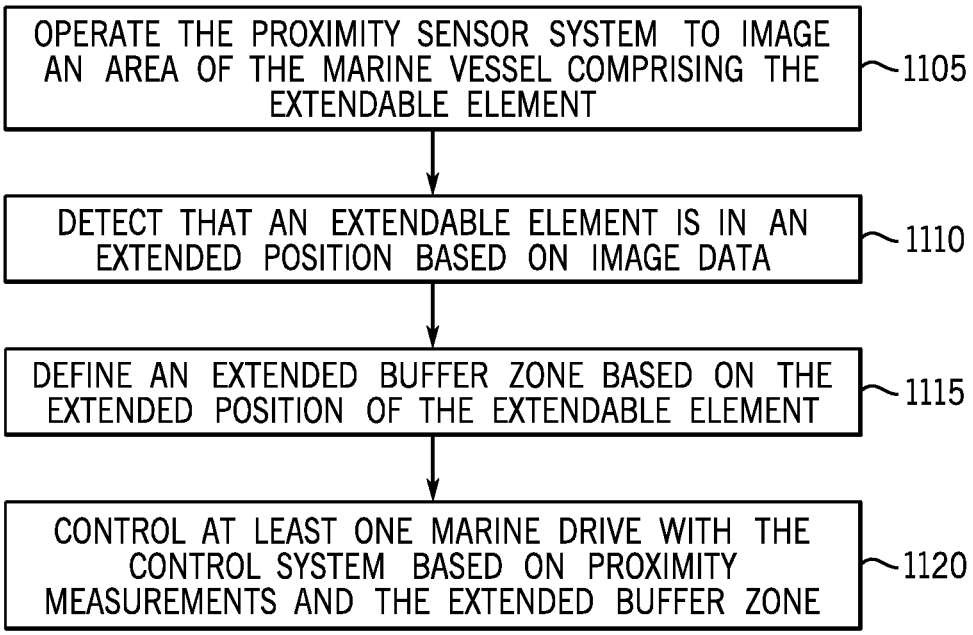

Referring now to FIG. 11, another exemplary method of propulsion control is illustrated. At 1105, the proximity sensor system is operated by the control system to image an area of the marine vessel comprising the extendable element. The extendable element may be a folding gunwale, a gangplank, at least one davit, a movable swim platform, or the like configured to extend from one of the sides or the stern of the marine vessel when in the extended position. At 1110, the control system detects that an extendable element is in an extended position based on the proximity data or image data. In one embodiment, the control system may be configured to detect intermediary positions between the fully extended and fully retracted positions. At 1115, an extended buffer zone is extended based on the extended position of the extendable element. At 1120, at least one marine drive is controlled by the control system based on the proximity measurements and the buffer zone.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A propulsion control system for a marine vessel, the system comprising:

at least one marine drive configured to propel the marine vessel;

a proximity sensor system configured to measure proximity of objects in a marine navigation area around the marine vessel to generate proximity measurements;

a control system configured to:

detect that an extendable element on the marine vessel is in an extended position;

define an extended buffer zone around the marine vessel based on the extended position of the extendable element; and control the at least one marine drive based on the proximity measurements and the extended buffer zone.

2. The system of claim 1, wherein the extended buffer zone is larger in at least one dimension than a non-extended buffer zone defined when the extendable element is not in the extended position.

3. The system of claim 2, wherein the extendable element is configured to extend from a side of the marine vessel when in the extended position, and wherein the extended buffer zone is wider than the non-extended buffer zone defined when the extendable element is not in the extended position.

4. The system of claim 2, wherein the extendable element is configured to extend from a stern of the marine vessel when in the extended position, and wherein the extended buffer zone is longer than the non-extended buffer zone defined when the extendable element is not in the extended position.

5. The system of claim 1, wherein the extended buffer zone is configured to extend at least a predetermined buffer distance around the extended element in the extended position.

6. The system of claim 1, wherein the extendable element is a folding gunwale configured to extend from a side of the marine vessel when in the extended position.

7. The system of claim 1, wherein the extendable element is a gangplank, at least one davit, a movable swim platform configured to extend from one of a side or a stern of the marine vessel when in the extended position.

8. The system of claim 1, further comprising at least one sensor configured to output sensor information indicative of whether the extendable element is in the extended position, wherein the control system is configured to detect that the extendable element is in the extended position based on the sensor information.

9. The system of claim 1, wherein the control system is configured to detect that the extendable element is extended based on perception data from the proximity sensor system.

10. The system of claim 9, wherein the proximity sensor system comprises at least one sensor configured to image an area of the marine vessel comprising the extendable element and generate the perception data showing the area of the marine vessel;

wherein the control system is configured to detect that the extendable element is in the extended position based on the perception data.

11. A propulsion control method for a marine vessel, the method comprising:

measuring proximity of objects around the marine vessel via a proximity sensor system to generate proximity measurements;

detecting that an extendable element on the marine vessel is in an extended position;

defining an extended buffer zone around the marine vessel with a control system based on the extended position of the extendable element; and controlling at least one marine drive with the control system based on the proximity measurements and the buffer zone so as to avoid the objects in a marine navigation area around the marine vessel entering the extended buffer zone.

12. The method of claim 11, wherein the extended buffer zone is larger in at least one dimension than a non-extended buffer zone defined when the extendable element is not in the extended position.

13. The method of claim 12, wherein the extendable element extends from a side of the marine vessel when in the extended position, and wherein the extended buffer zone is wider than the non-extended buffer zone defined when the extendable element is not in the extended position.

14. The method of claim 12, wherein the extendable element extends from a stern of the marine vessel when in the extended position, and wherein the extended buffer zone is longer than the non-extended buffer zone defined when the extendable element is not in the extended position.

15. The method of claim 11, wherein the extended buffer zone is defined to extend at least a predetermined buffer distance around the extended element in the extended position.

16. The method of claim 11, wherein the extendable element is a folding gunwale that extends from a side of the marine vessel when in the extended position.

17. The method of claim 11, wherein the extendable element is a gangplank, at least one davit, a movable swim platform that extends from one of a side or a stern of the marine vessel when in the extended position.

18. The method of claim 11, further comprising operating at least one sensor to output sensor information indicative of whether the extendable element is in the extended position, wherein the detection that the extendable element is in the extended position is based on the sensor information.

19. The method of claim 11, wherein the detection that the extendable element is in the extended position is based on data from the proximity sensor system.

20. The method of claim 19, further comprising operating the proximity sensor system to image an area of the marine vessel comprising the extendable element and generate image data showing the area of the marine vessel; and detecting that the extendable element is in the extended position based on the image data.

* * * * *